US011519234B2

(12) United States Patent
Pray et al.

(10) Patent No.: US 11,519,234 B2
(45) Date of Patent: Dec. 6, 2022

(54) CONTINGENCY RELEASE OF MILL FROM WHIPSTOCK

(71) Applicant: WEATHERFORD TECHNOLOGY HOLDINGS, LLC, Houston, TX (US)

(72) Inventors: Jeffery Scott Pray, Shenandoah, TX (US); David W. Teale, Spring, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 121 days.

(21) Appl. No.: 17/103,838

(22) Filed: Nov. 24, 2020

(65) Prior Publication Data

US 2022/0162920 A1 May 26, 2022

(51) Int. Cl.
*E21B 23/00* (2006.01)
*E21B 23/01* (2006.01)
*E21B 29/06* (2006.01)

(52) U.S. Cl.
CPC ..... *E21B 23/00* (2013.01); *E21B 23/01* (2013.01); *E21B 29/06* (2013.01)

(58) Field of Classification Search
CPC ..... E21B 23/00; E21B 23/01; E21B 29/06; E21B 7/061
See application file for complete search history.

(56) References Cited

U.S. PATENT DOCUMENTS 2,207,920 A 7/1940 Hughes
3,339,636 A * 9/1967 Frisby ..... E21B 34/12 166/334.1
5,887,655 A 3/1999 Haugen et al.
7,878,253 B2 * 2/2011 Stowe ..... E21B 23/04 166/381
8,141,634 B2 3/2012 Fisher et al.
(Continued)

FOREIGN PATENT DOCUMENTS

EP 0948700 B1 1/2006
WO 2009/137537 A2 11/2009
WO 2020/002936 A1 1/2020

OTHER PUBLICATIONS

Office Action dated Apr. 28, 2022 for U.S. Appl. No. 17/184,628, 23 pages.

(Continued)

*Primary Examiner* — Steven A MacDonald
(74) *Attorney, Agent, or Firm* — Smith IP Services P.C.

(57) ABSTRACT

A bottom hole assembly can include a mill and a whipstock having an upper end and an opening. A retractable pin extends from the mill into the opening. A section of the whipstock is separable from the whipstock in response to a force applied to the mill. The section is positioned between the opening and the upper end. A method can include positioning a bottom hole assembly in a well, the bottom hole assembly including a whipstock releasably secured to a mill, and then releasing the mill from the whipstock by separating a section of the whipstock from a remainder of the whipstock. Another method can include conveying a bottom hole assembly into a well, setting an anchor, then applying pressure to a hydraulic release mechanism, and then applying a force to the mill, thereby separating a section of the whipstock from a remainder of the whipstock.

20 Claims, 6 Drawing Sheets

(56) References Cited

U.S. PATENT DOCUMENTS

| | | | | |
|---|---|---|---|---|
| 8,833,442 | B2 * | 9/2014 | Ibragimov | E21B 7/061 166/117.6 |
| 9,004,159 | B2 * | 4/2015 | Alsup | E21B 29/06 166/117.6 |
| 10,704,328 | B2 * | 7/2020 | Korf | E21B 7/061 |
| 2010/0012322 | A1 * | 1/2010 | McGarian | E21B 7/061 166/298 |
| 2010/0224372 | A1 * | 9/2010 | Stowe | E21B 29/06 403/2 |
| 2012/0261193 | A1 * | 10/2012 | Swadi | E21B 7/061 175/75 |
| 2013/0319653 | A1 * | 12/2013 | Ibragimov | E21B 7/061 166/117.6 |
| 2014/0360723 | A1 | 12/2014 | Utter et al. | |
| 2015/0211318 | A1 * | 7/2015 | Redlinger | E21B 31/113 166/66.4 |
| 2016/0238055 | A1 * | 8/2016 | Donovan | E21B 29/06 |
| 2018/0225485 | A1 | 8/2018 | Ownby et al. | |
| 2019/0003264 | A1 | 1/2019 | Swadi et al. | |
| 2019/0106940 | A1 * | 4/2019 | Korf | E21B 7/061 |
| 2020/0131886 | A1 | 4/2020 | Hora et al. | |
| 2020/0190908 | A1 | 6/2020 | Pray et al. | |
| 2021/0372219 | A1 * | 12/2021 | Brown-Kerr | E21B 7/061 |

OTHER PUBLICATIONS

International Search Report with Written Opinion dated Jan. 31, 2022 for PCT Patent Application No. PCT/US2021/054634, 12 pages.

International Search Report with Written Opinion dated Mar. 15, 2022 for PCT Patent Application No. PCT/US2022/013201, 13 pages.

Techmaster Oil Tools Inc.; "MasterWhipstock", company brochure via www.TMOT.ca, dated 2019, 21 pages.

Weatherford; "QuickCut Casing Exit System RHS-Type Anchor", company brochure 2697.03, dated 2006-2012, 4 pages.

Weatherford; "Shallow-Angle QuickCut Casing Exit System RHS-Type Anchor", company brochure 2702.02, dated 2008-2011, 4 pages.

Weatherford; "Shallow-Angle QuickCut Casing Exit System RMN-Type Anchor or RHN-Type Anchor", company brochure 2700.01, dated 2008, 4 pages.

Wellbore Integrity Solutions; "Trackmaster Select", company brochure 16-BDT-131810 | WIS-BR-MKT-010_rev2 via www.wellboreintegrity.com, dated 2019, 9 pages.

* cited by examiner

CONTINGENCY RELEASE OF MILL FROM WHIPSTOCK

BACKGROUND

This disclosure relates generally to equipment utilized and operations performed in conjunction with a subterranean well and, in an example described below, more particularly provides for contingency release of a mill from a whipstock.

A whipstock is sometimes used in well drilling operations to form a lateral or branch wellbore from a main or parent wellbore. If the main or parent wellbore is lined with casing, a window may be formed through the casing by use of the whipstock with a mill specifically designed for this purpose.

Typically, the whipstock is releasably attached to the mill during conveyance of this equipment into the well. When the whipstock is at a desired position, an anchor is set and the mill is released from the whipstock.

A shearable bolt is typically used to releasably secure the whipstock to the mill. However, the bolt may be inadvertently or prematurely sheared, for example, if an obstruction is encountered during the conveyance of the equipment into the well, substantial changes in wellbore direction are encountered, etc.

Therefore, it will be readily appreciated that improvements are continually needed in the art of designing, constructing and operating mechanisms for releasing mills from whipstocks in wells. Such improvements may be useful in a variety of different drilling operations, such as, forming casing exit windows, drilling lateral or branch wellbores, sidetracking, etc.

DETAILED DESCRIPTION

Figure 1:
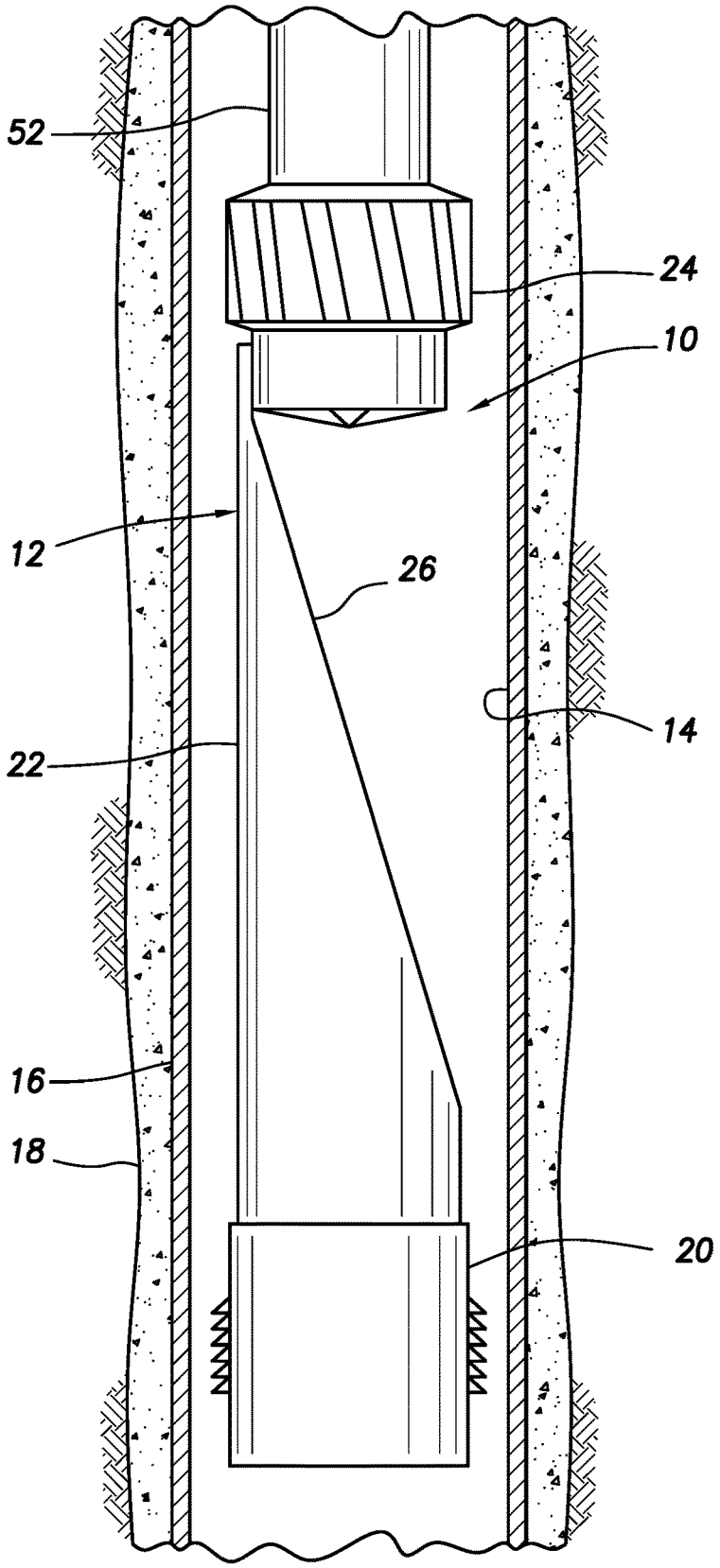
FIG. 1 is a representative partially cross-sectional view of an example of a well system and associated method which can embody principles of this disclosure.

Representatively illustrated in FIG. 1 is a system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a bottom hole assembly 12 is being conveyed into a wellbore 14 that is lined with casing 16 and cement 18. It is desired, in this example, to drill another wellbore (such as, a branch or lateral wellbore) intersecting the wellbore 14.

The bottom hole assembly 12 includes an anchor 20, a whipstock 22 and a mill 24. Additional or different components (such as, a casing collar locator, an orienting device, etc.) may be used in other examples. The scope of this disclosure is not limited to the use of any particular components or combination of components in a bottom hole assembly.

The anchor 20 is used to secure the whipstock 22 at a desired position in the wellbore 14 for forming an exit window through the casing 16. The anchor 20 may be set in the wellbore 14 using a variety of different techniques, such as, by applying hydraulic pressure to a setting mechanism of the anchor, by mechanical manipulation of the anchor (for example, raising, rotating, lowering, etc.), or by inflating an elastomeric element of the anchor.

In some examples, the anchor 20 may include slips for gripping an inner surface of the casing 16, or keys that engage one or more corresponding profiles formed in the casing. The anchor 20 could be a packer, or an anchoring device without an annular seal element for sealing against the casing 16. The scope of this disclosure is not limited to use of any particular type of anchor in a bottom hole assembly, or to any particular technique for securing the anchor in a wellbore.

The whipstock 22 is used to laterally deflect the mill 24. For this purpose, the whipstock 22 includes an inclined surface 26 formed thereon. When the mill 24 is displaced downhole relative to the whipstock 22 after the anchor 20 is set, the inclined surface 26 will deflect the mill laterally, thereby causing the mill to cut an opening or window through the casing 16.

In the example depicted in FIG. 1, the mill 24 is of the type known to those skilled in the art as a lead or pilot mill specially configured to initiate the cutting of the window through the casing 16. A drill string 52 connected above the mill 24 can include other types of mills and other cutting devices, such as, watermelon mills, finishing mills, etc. The scope of this disclosure is not limited to use of any particular type or combination of mills or other cutting devices in a drill string.

The mill 24 in this example is also specially configured for releasable attachment to the whipstock 22, as described more fully below. It is desirable for the anchor 20, the whipstock 22 and the mill 24 to be conveyed into the wellbore 14 in a single trip into the well, for convenience, efficiency and reduced expense. Thus, after the whipstock 22 has been appropriately positioned in the wellbore 14 and the anchor 20 has been set, the mill 24 is released from the whipstock and is displaced downhole while rotating, in order to begin cutting through the casing 16.

Figure 2:
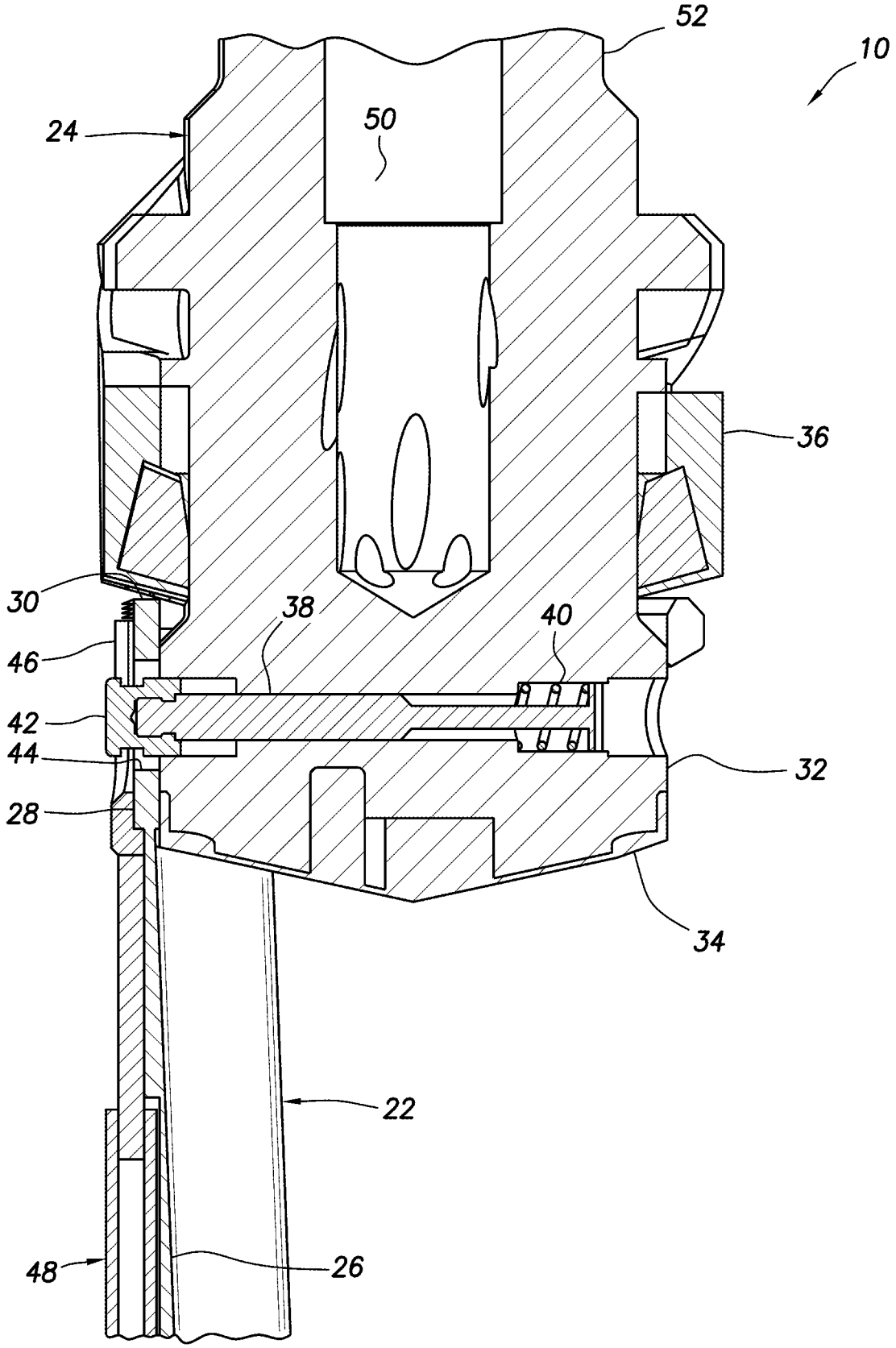
FIG. 2 is a representative cross-sectional view of an example of a hydraulic release mechanism that releasably secures a mill to a whipstock.

Referring additionally now to FIG. 2, a more detailed cross-sectional view of an example of the releasable attachment between the mill 24 and the whipstock 22 is representatively illustrated. In this example, an annular section 28 near an upper end 30 of the whipstock 22 is releasably secured to an outer diameter 32 of the mill 24 positioned longitudinally between cutting structures 34, 36 on the mill.

As depicted in FIG. 2, a retractable pin 38 is laterally slidingly received in the mill 24. The pin 38 is biased rightward (as viewed in FIG. 2) by a spring 40 or another biasing device. The pin 38 has a grooved head 42 that is received in an opening 44 formed through the annular section 28 of the whipstock 22.

A latch member 46 of a hydraulic release mechanism 48 initially retains the head 42 in the opening thereby preventing the pin 38 from fully retracting into the mill 24. The latch member 46 is configured to engage the grooved head 42 and thereby prevent retraction of the pin 38 when the latch member is in an upper position as depicted in FIG. 2.

However, when the hydraulic release mechanism 48 is actuated to displace the latch member 46 downward and out of engagement with the grooved head 42, the spring 40 will then be able to displace the pin 38 to the right (as viewed in FIG. 2). This will withdraw the head 42 from the opening 44, and will thereby permit the mill 24 to be displaced downhole relative to the whipstock 22.

Suitable hydraulic release mechanisms are described in U.S. Pat. No. 10,704,328 and US publication no. 2020/0190908, the entire disclosures of which are incorporated herein by this reference in their entireties for all purposes. A hydraulic release mechanism described in the U.S. Pat. No. 10,704,328 and US publication no. 2020/0190908 is actuated by flowing fluid through an internal flow passage 50 extending through the drill string 52. When a flow rate of the fluid is increased to a predetermined level, hydraulic pressure is applied to one or more pistons of the hydraulic release mechanism 48, thereby causing the latch member 46 to be displaced downward and out of engagement with the head 42.

Figure 3:
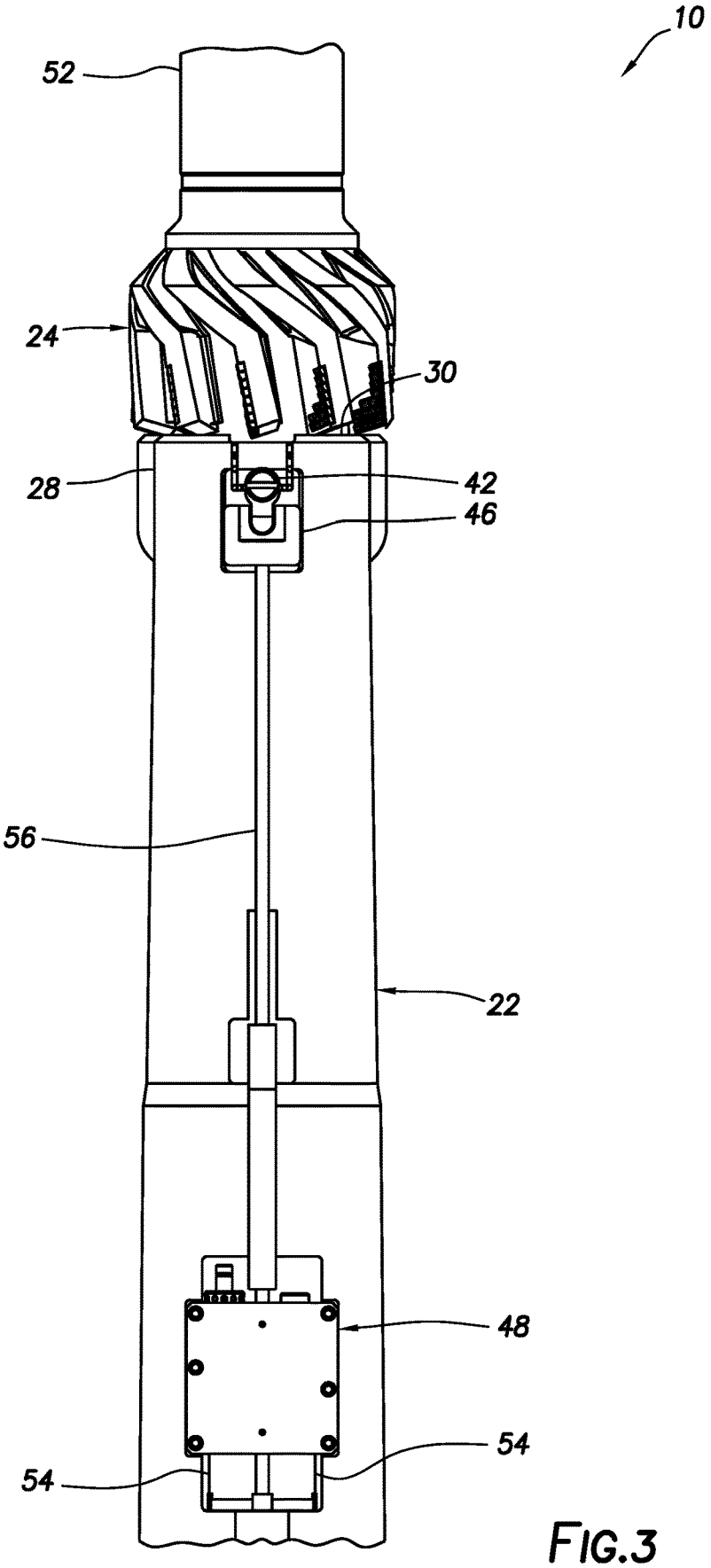
FIG. 3 is a representative side view of the hydraulic release mechanism in a release configuration.

Referring additionally now to FIG. 3, a side view of the mill 24 and the whipstock 22 is representatively illustrated. In this view, the hydraulic release mechanism 48 has been actuated by the increased hydraulic pressure caused by the fluid flow through the flow passage 50.

Pistons 54 of the hydraulic release mechanism 48 have displaced downward due to the increased hydraulic pressure. The pistons 54 are connected to the latch member 46 via a rod, cable or other linkage 56. Thus, the latch member 46 is displaced downward out of engagement with the head 42 of the pin 38 in response to the increased hydraulic pressure applied to the hydraulic release mechanism 48.

It is possible that the hydraulic release mechanism 48 could fail to operate as intended. For example, a piston seal or another hydraulic component of the hydraulic release mechanism 48 could malfunction, a hydraulic connection could leak, a mechanical component could bind, etc. Alternatively, the hydraulic release mechanism 48 could operate as intended, displacing the latch member 46 downward when appropriate, but the pin 38 could fail to retract into the mill 24.

In these situations or others, it would be desirable to be able to release the mill 24 from the whipstock 22, so that the milling operation can preferably be continued or the mill can be retrieved from the well, with the whipstock 22 remaining operatively secured in the wellbore 14. For this purpose, the system 10 includes a contingency release feature that allows the whipstock 22 and the mill 24 to be disconnected from each other, even if the hydraulic release mechanism 48 fails or the pin 38 fails to fully retract into the mill 24.

Figure 4:
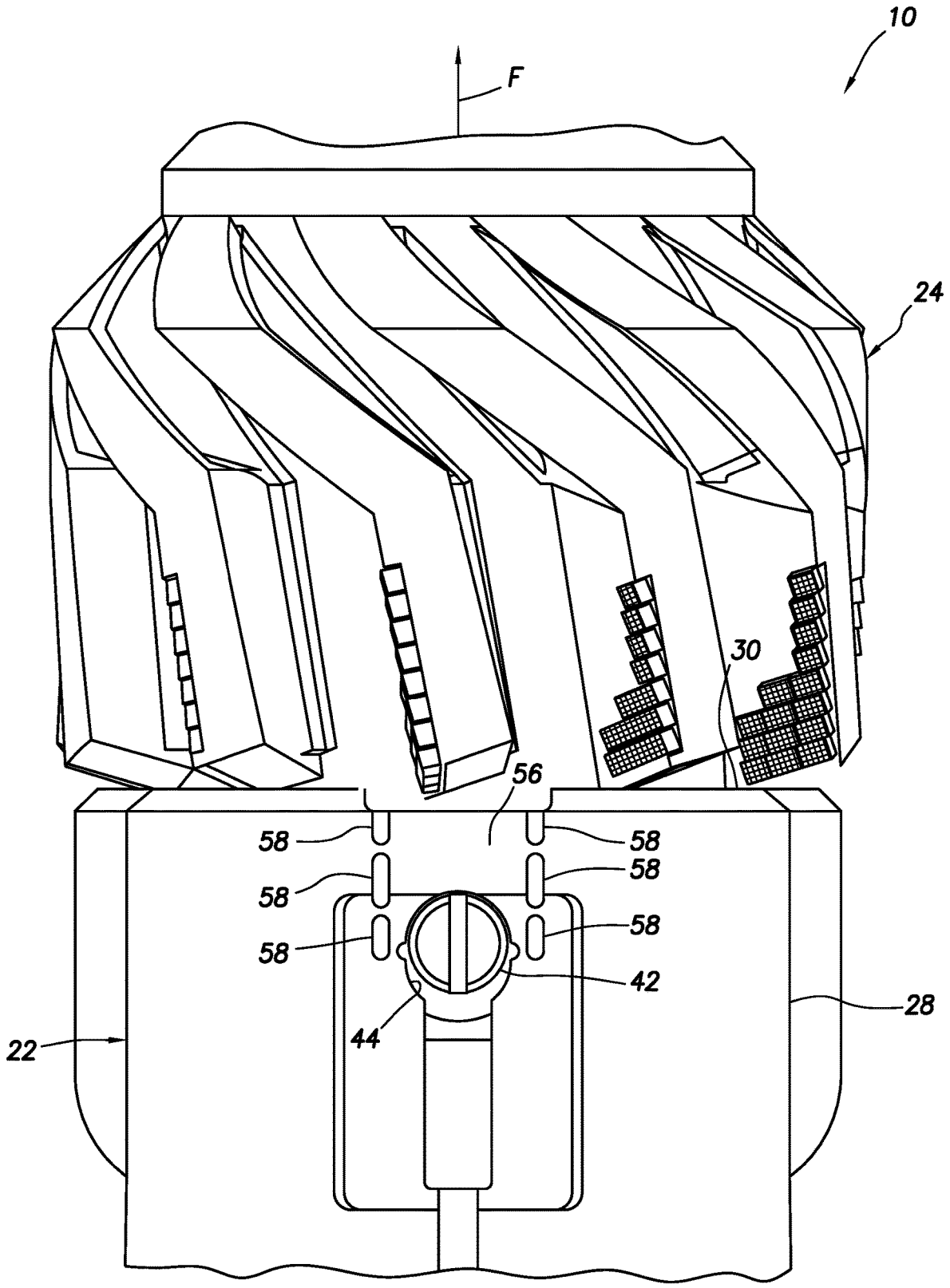
FIG. 4 is a representative side view of an example of a contingency release feature.

Referring additionally now to FIG. 4, a side view of the contingency release feature is representatively illustrated. In this view, the latch member 46 is not shown for clarity of illustration and description.

As depicted in FIG. 4, the head 42 remains in the opening 44. It will be appreciated that, if an uphole directed force F is applied to the mill 24, the force will be transmitted via the head 42 to a section 56 of the whipstock 22 positioned longitudinally between the opening 44 and the upper end 30 of the whipstock.

In the FIG. 4 example, a periphery of the section 56 is weakened relative to a remainder of the annular section 28 by forming holes or perforations 58 through the annular section. The perforations 58 may be round, elliptical, oval, slotted or any other shape. As described more fully below, the periphery of the section 56 may be further weakened by forming grooves or recesses about the periphery of the section 56.

When the applied force F is increased to a sufficient level, the periphery of the section 56 will break (for example, shearing between the perforations 58 and otherwise separating from the remainder of the annular section 28). The section 56 will separate from the remainder of the whipstock 22 and the mill 24 will thereby be released from its attachment to the whipstock.

If the head 42 had previously remained engaged with the opening 44 due to a failure of the hydraulic release mechanism 48, upward displacement of the mill 24 relative to the whipstock 22 after separation of the section 56 will permit the head to be disengaged from the latch member 46, and will thus enable the pin 38 to fully retract. The mill 24 can then be displaced downward relative to the whipstock 22 to thereby cut through the casing 16 (see FIG. 1).

If the head 42 had previously remained engaged with the opening 44 due to binding or the presence of debris, etc., upward displacement of the mill 24 relative to the whipstock 22 after separation of the section 56 may permit the head to be disengaged from the latch member 46 and enable the pin 38 to fully retract. The mill 24 may then be displaced downward relative to the whipstock 22 to thereby cut through the casing 16, or the mill may be retrieved from the well for repair or replacement. Note that the contingency release feature is configured to prevent binding of the head 42 in the opening 44 and to prevent undesirable loading of the head, as described more fully below.

Figure 5:
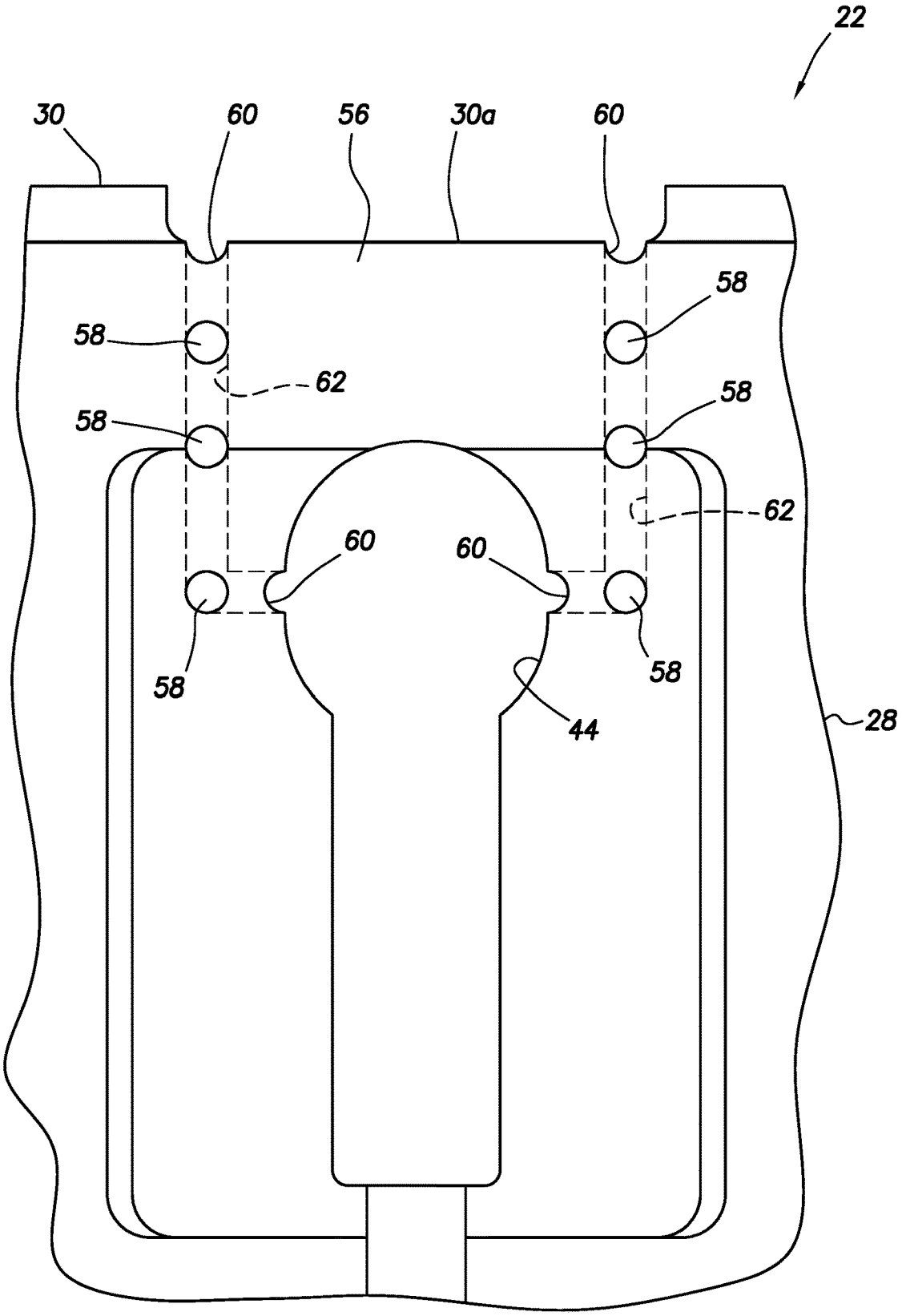
FIG. 5 is a representative outer view of an upper portion of a whipstock.

Referring additionally now to FIG. 5, an exterior view of an upper portion of the whipstock 22 is representatively illustrated. The upper portion depicted in FIG. 5 includes the section 56 of the whipstock 22.

It will be appreciated that the presence of the perforations 58 through the annular section 28 weakens the periphery of the section 56. In addition, recesses 60 formed at opposite ends of the section 56 periphery function to control initiation of breaking or shearing of the periphery when the force F is applied to the section 56 as described above.

The periphery of the section 56 is further weakened by the presence of recesses or grooves 62 along the periphery on an interior of the annular section 28. A level of the force F required to separate the section 56 from the remainder of the annular section 28 can be varied by selecting appropriate dimensions (diameters, depths, numbers, configurations, etc.) of the perforations 58, recesses 60 and grooves 62.

Other types of features (such as, slots, scoring, etc.) may be used to weaken the periphery of the section 56 in other examples. The scope of this disclosure is not limited to use of any particular type or combination of features used to provide a known and consistent separation of the section 56 from the remainder of the annular section 28 in response to application of a predetermined level of the force F.

Note that the opening 44 is elongated in a longitudinal direction where the head 42 is received in the opening. In addition, a portion 30*a* of the upper end 30 of the whipstock 22 is recessed between opposite lateral sides of the section 56. These features prevent downwardly directed forces from being transmitted from the mill 24 to the head 42 or the section 56 during conveyance of the bottom hole assembly 12 into the well. In particular, a compressive force cannot be transmitted between the section 56 and the mill 24.

Figure 6:
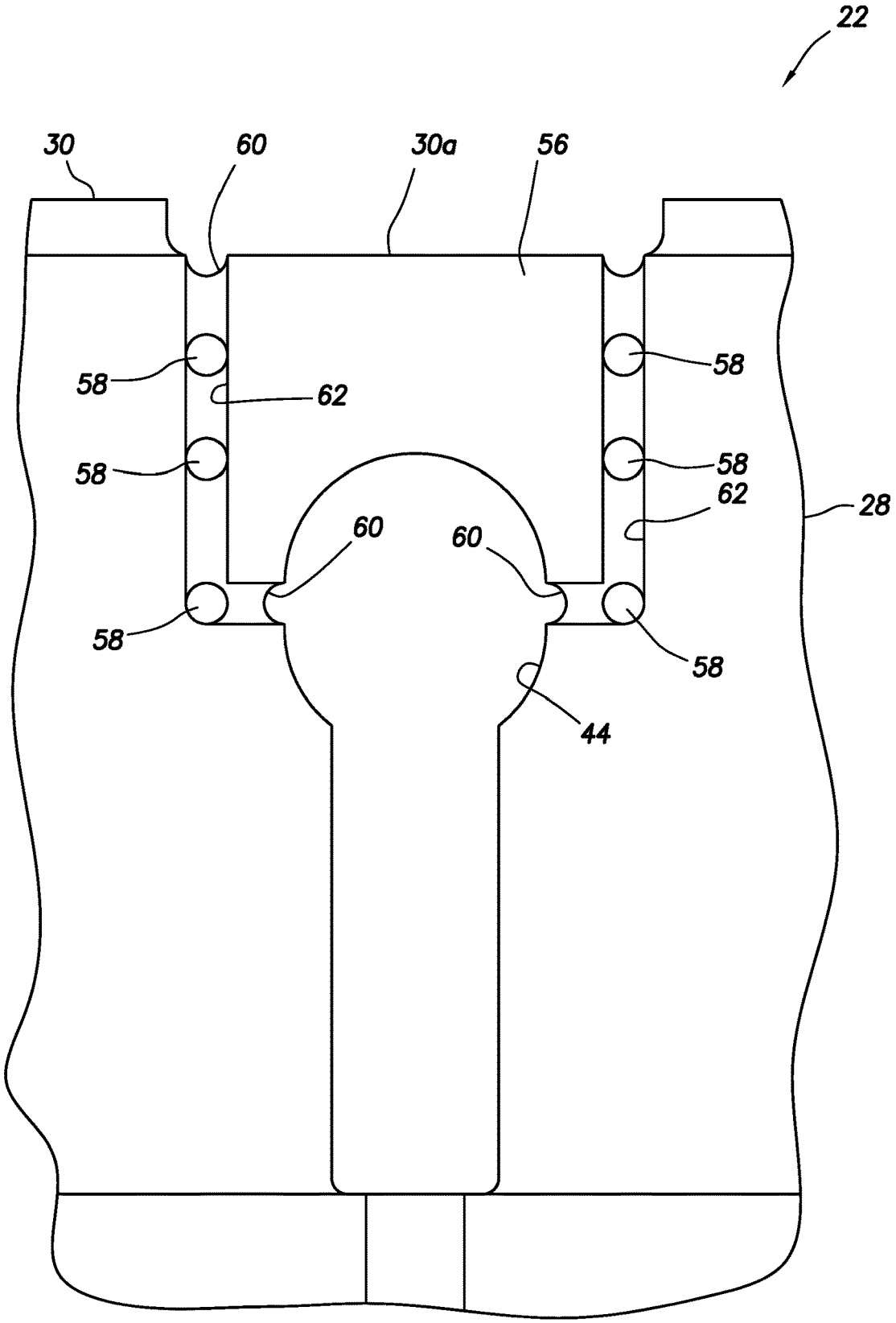
FIG. 6 is a representative inner view of the upper portion of the whipstock.

Referring additionally now to FIG. 6, an interior view of the upper portion of the whipstock 22 is representatively illustrated. In this view, the manner in which the recesses 62 extend about the periphery of the section 56 is visible.

When the predetermined level of the uphole directed force F is applied to the section 56, the periphery of the section 56 will shear or otherwise break, thereby allowing the section 56 to be separated from the remainder of the whipstock 22. This will release the mill 24 from the whipstock 22 as described above. The portion 30*a* of the upper end 30 of the whipstock 22 is part of the section 56 and will, thus, be separated from the remainder of the annular section 28 when the predetermined level of the uphole directed force F is applied to the section 56.

In another example, instead of the perforations 58 and recesses 62, the section 56 could be made thinner than the remainder of the annular section 28. For example, the interior and/or exterior of the section 56 could be recessed, such as, by milling away a surface of the interior and/or exterior of the section 56.

In yet another example, the section 56 could be initially separate from the remainder of the annular section 28, and could then be joined to the annular section 28 by techniques, such as, bonding, brazing, welding, etc., in a manner that creates a weakened area (having less strength than the remainder of the annular section 28) at the joint between the section 56 and the remainder of the annular section 28.

It may now be fully appreciated that the above disclosure provides significant advancements to the art of designing, constructing and operating mechanisms for releasing mills from whipstocks in wells. In an example described above, the mill 24 can be reliably and conveniently released from the whipstock 22 by separating a section 56 from a remainder of the whipstock.

In one example, a bottom hole assembly 12 for use in a subterranean well can include a mill 24, and a whipstock 22 secured to the mill 24, the whipstock 22 having an upper end 30 and an opening 44 spaced apart from the upper end 30. A retractable pin 38 extends from the mill 24 into the opening 44. A section 56 of the whipstock 22 is separable from the whipstock 22 in response to a force F applied to the mill 24. The section 56 of the whipstock 22 is positioned between the opening 44 and the upper end 30 of the whipstock 22.

The whipstock 22 may be weakened between the opening 44 and the upper end 30 of the whipstock 22. The whipstock 22 may be weakened by at least one perforation 58 formed through the whipstock 22 longitudinally between the opening 44 and the upper end 30 of the whipstock 22. The whipstock 22 may be weakened by at least one recess 60, 62 formed in the whipstock 22 longitudinally between the opening 44 and the upper end 30 of the whipstock 22.

The whipstock 22 may include a hydraulic release mechanism 48 configured to selectively prevent and permit retraction of the pin 38. The section 56 of the whipstock 22 may be separable from the whipstock 22 before and/or after the hydraulic release mechanism 48 permits retraction of the pin 38.

The section 56 of the whipstock 22 may include a portion 30*a* of the upper end 30 of the whipstock 22.

In one example, a method for use with a subterranean well can include positioning a bottom hole assembly 12 in the well, the bottom hole assembly 12 including a mill 24 and a whipstock 22 releasably secured to the mill 24, and then releasing the mill 24 from the whipstock 22 by separating a section 56 of the whipstock 22 from a remainder of the whipstock 22.

The separating step may include shearing a weakened area of the whipstock 22. The method may include forming the weakened area by forming at least one perforation 58 through the whipstock 22. The method may include forming the weakened area by forming at least one recess 60, 62 in the whipstock 22.

The releasing step may include applying a force F to the mill 24 in an uphole direction. The method may include applying an increased hydraulic pressure to a hydraulic release mechanism 48 of the whipstock 22 prior to applying the force F to the mill.

The section 56 of the whipstock 22 may include a portion 30*a* of an upper end 30 of the whipstock 22. The section 56 of the whipstock 22 may be positioned between an opening 44 and an upper end 30 of the whipstock 22, and a retractable pin 38 may extend from the mill 24 into the opening 44.

The bottom hole assembly 12 may be configured so that a compressive force cannot be transmitted between the mill 24 and the section 56 of the whipstock 22.

In one example, a method for use with a subterranean well can include conveying a bottom hole assembly 12 into the well, the bottom hole assembly 12 including an anchor 20, a whipstock 22 and a mill 24, setting the anchor 20, then applying increased hydraulic pressure to a hydraulic release mechanism 48 of the whipstock 22, and then applying a force F in an uphole direction to the mill 24, thereby separating a section 56 of the whipstock 22 from a remainder of the whipstock 22.

The separating step may include shearing a weakened area of the whipstock 22. The method may include forming the weakened area by forming at least one perforation 58 through the whipstock 22. The method may include forming the weakened area by forming at least one recess 60, 62 in the whipstock 22.

The section 56 of the whipstock 22 may include a portion 30*a* of an upper end 30 of the whipstock 22.

The section 56 of the whipstock 22 may be positioned between an opening 44 formed through the whipstock 22 and an upper end 30 of the whipstock 22, and a retractable pin 38 may extend from the mill 24 into the opening 44.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A bottom hole assembly for use in a subterranean well, the bottom hole assembly comprising:

a mill; and a whipstock secured to the mill, the whipstock having an upper end and an opening spaced apart from the upper end, in which a retractable pin extends from the mill into the opening, in which a section of the whipstock is configured to separate from the whipstock in response to a force applied to the mill, the section of the whipstock being positioned between the opening and the upper end of the whipstock, and in which a compressive force cannot be transmitted between the mill and the section of the whipstock.

2. The bottom hole assembly of claim 1, in which the whipstock is weakened between the opening and the upper end of the whipstock.

3. The bottom hole assembly of claim 2, in which the whipstock is weakened by at least one perforation formed through the whipstock longitudinally between the opening and the upper end of the whipstock.

4. The bottom hole assembly of claim 2, in which the whipstock is weakened by at least one recess formed in the whipstock longitudinally between the opening and the upper end of the whipstock.

5. The bottom hole assembly of claim 1, in which the whipstock includes a hydraulic release mechanism configured to selectively prevent and permit retraction of the pin, and in which the section of the whipstock is configured to separate from the whipstock before and after the hydraulic release mechanism permits retraction of the pin.

6. The bottom hole assembly of claim 1, in which the section of the whipstock comprises a portion of the upper end of the whipstock.

7. A method for use with a subterranean well, the method comprising:

positioning a bottom hole assembly in the well, the bottom hole assembly including a mill and a whipstock releasably secured to the mill; and then releasing the mill from the whipstock by separating a section of the whipstock from a remainder of the whipstock, in which a compressive force cannot be transmitted between the mill and the section of the whipstock.

8. The method of claim 7, in which the separating comprises shearing a weakened area of the whipstock.

9. The method of claim 8, further comprising forming the weakened area by forming at least one perforation through the whipstock.

10. The method of claim 8, further comprising forming the weakened area by forming at least one recess in the whipstock.

11. The method of claim 7, in which the releasing comprises applying a force to the mill in an uphole direction.

12. The method of claim 11, further comprising applying an increased hydraulic pressure to a hydraulic release mechanism of the whipstock prior to applying the force to the mill.

13. The method of claim 7, in which the section of the whipstock comprises a portion of an upper end of the whipstock.

14. The method of claim 7, in which the section of the whipstock is positioned between an opening and an upper end of the whipstock, and a retractable pin extends from the mill into the opening.

15. A method for use with a subterranean well, the method comprising:

conveying a bottom hole assembly into the well, the bottom hole assembly comprising an anchor, a whipstock and a mill;

setting the anchor;

then applying increased hydraulic pressure to a hydraulic release mechanism of the whipstock; and then applying a force in an uphole direction to the mill, thereby separating a section of the whipstock from a remainder of the whipstock, in which the section of the whipstock is positioned between an opening formed through the whipstock and an upper end of the whipstock, and a retractable pin extends from the mill into the opening.

16. The method of claim 15, in which the separating comprises shearing a weakened area of the whipstock.

17. The method of claim 16, further comprising forming the weakened area by forming at least one perforation through the whipstock.

18. The method of claim 16, further comprising forming the weakened area by forming at least one recess in the whipstock.

19. The method of claim 15, in which the section of the whipstock comprises a portion of the upper end of the whipstock.

20. The method of claim 15, in which a compressive force cannot be transmitted between the mill and the section of the whipstock.

* * * * *